US012035790B2

(12) United States Patent
Speelman

(10) Patent No.: US 12,035,790 B2
(45) Date of Patent: Jul. 16, 2024

(54) TRAVEL ACCESSORY

(71) Applicant: Wilma Speelman, Wooster, OH (US)

(72) Inventor: Wilma Speelman, Wooster, OH (US)

( * ) Notice: Subject to any disclaimer, the term of this patent is extended or adjusted under 35 U.S.C. 154(b) by 0 days.

(21) Appl. No.: 17/859,718

(22) Filed: Jul. 7, 2022

(65) Prior Publication Data

US 2023/0114097 A1 Apr. 13, 2023

Related U.S. Application Data

(60) Provisional application No. 63/219,111, filed on Jul. 7, 2021.

(51) Int. Cl.

| | |
|---|---|
| ***A45C 3/06*** | (2006.01) |
| ***A45C 3/00*** | (2006.01) |
| ***A45C 13/00*** | (2006.01) |
| ***A45C 13/10*** | (2006.01) |
| ***A45C 13/30*** | (2006.01) |
| ***A45F 3/02*** | (2006.01) |

(52) U.S. Cl.

CPC ..... *A45C 3/06* (2013.01); *A45C 13/001* (2013.01); *A45C 13/103* (2013.01); *A45C 13/1076* (2013.01); *A45C 13/30* (2013.01); *A45F 3/02* (2013.01); *A45C 2003/005* (2013.01); *A45C 2013/306* (2013.01)

(58) Field of Classification Search

CPC ..... A45C 3/06; A45C 13/001; A45C 13/103; A45C 13/1076; A45C 13/30; A45C 2003/005; A45C 2013/306; A45C 9/00; A45F 3/02

USPC ..... 2/202; 383/7, 37; 224/609; 190/111

See application file for complete search history.

(56) References Cited

U.S. PATENT DOCUMENTS

| | | | | |
|---|---|---|---|---|
| 4,442,960 | A * | 4/1984 | Vetter | B62J 9/23 383/14 |
| D344,184 | S * | 2/1994 | Barker | 224/609 |
| D404,910 | S * | 2/1999 | Schober | D3/216 |
| 6,135,333 | A * | 10/2000 | Tucker | A01M 31/00 224/931 |
| D544,708 | S * | 6/2007 | Barker | D3/216 |
| D605,849 | S * | 12/2009 | Mori | D3/217 |
| 7,996,921 | B1 * | 8/2011 | Snyder | A41D 13/0012 2/102 |
| 10,278,481 | B2 * | 5/2019 | Toyras | A45C 3/004 |
| D945,154 | S * | 3/2022 | Dini | D3/231 |
| 2005/0103817 | A1 * | 5/2005 | Glankler | A45C 7/0086 224/583 |
| 2009/0223845 | A1 * | 9/2009 | Bosma | A45C 15/00 190/111 |

(Continued)

*Primary Examiner* — Don M Anderson
*Assistant Examiner* — Justin Caudill
(74) *Attorney, Agent, or Firm* — Kathleen K Bowen

(57) ABSTRACT

A travel accessory in the form of a travel bag, has at least two fabric pockets, two connecting strips, and a shoulder strap. The fabric pockets are connected to each other via the connecting strips. The travel bag is designed to be secured to a suitcase, specifically a carry-on sized suitcase. When a suitcase is standing on its wheels, the travel bag is laid over the suitcase, such that one pocket is on either side of the suitcase, and the connecting strips are over the top. The connecting strips are sized to reach from one side of the suitcase to the other. When the travel bag is not being secured to a suitcase, it can be carried like a purse by using the shoulder strap.

2 Claims, 7 Drawing Sheets

(56) References Cited

U.S. PATENT DOCUMENTS

| | | | | |
|---|---|---|---|---|
| 2012/0223114 | A1* | 9/2012 | Hunt | A45F 3/14 224/578 |
| 2014/0048575 | A1* | 2/2014 | Kennedy-Sharpe | A45C 3/00 224/637 |
| 2017/0042302 | A1* | 2/2017 | Farrelly | A45C 7/0045 |
| 2019/0216197 | A1* | 7/2019 | Katz | A45C 13/28 |
| 2019/0261754 | A1* | 8/2019 | Fujikura | A45C 13/30 |
| 2019/0269230 | A1* | 9/2019 | Powell | A45C 13/30 |
| 2020/0367624 | A1* | 11/2020 | Kayam | A45F 4/02 |
| 2021/0137235 | A1* | 5/2021 | Humphrey Felix | A45C 13/30 |

* cited by examiner

TRAVEL ACCESSORY

This application claims the benefit of U.S. Provisional Application No. 63/219,111 filed Jul. 7, 2021.

BACKGROUND

The present invention is in the field of travel accessories. More specifically this invention relates to accessories to be used in conjunction with a suitcase, when traveling through airports and the like. A travel bag and cup holder for use with a suitcase are described.

SUMMARY OF INVENTION

A bag for travel is designed such that it can be carried over the shoulder like a purse, or it can be laid over a wheeled suitcase, and secured to the suitcase for ease of travel. Additionally the bag may come with a cup holder which can also be secured to a suitcase to hold a traveler's beverage.

DETAILED DESCRIPTION

Various aspects of the invention are presented in FIGS. 1-6 which are not drawn to scale and in which like components are numbered alike. Referring ring now to FIGS. 1-6, a travel accessory in the form of a travel bag 1 is shown. This bag comprises at least two fabric pockets 10, two connecting strips 20, and a shoulder strap 30. The fabric pockets 10 are connected to each other via the connecting strips 20. The travel bag 1 is meant to be secured to a suitcase, specifically a carry-on sized suitcase.

Figure 1:
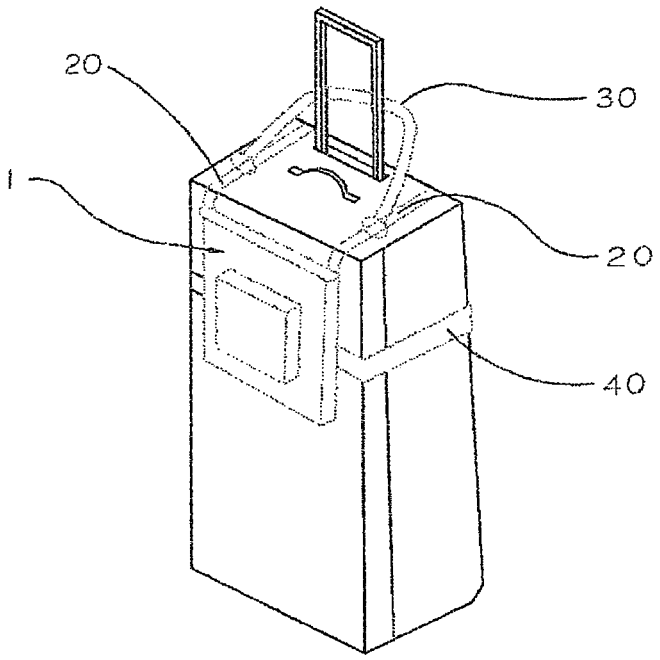
FIG. 1 is an isometric view of a travel accessory bag attached to a wheeled suitcase, according to an aspect of the invention.
Figure 2:
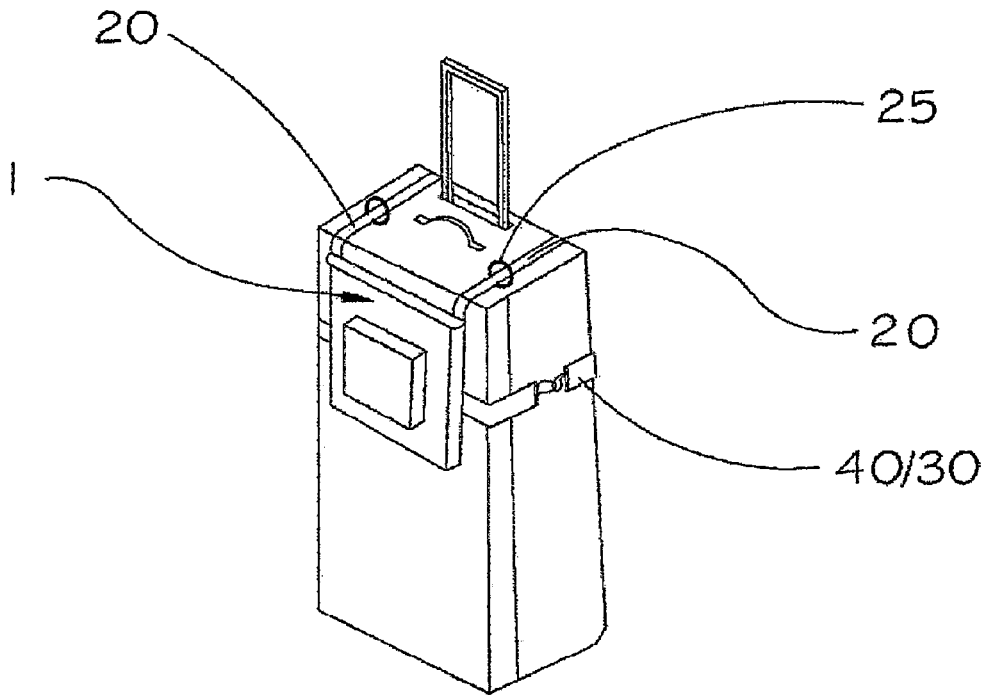
FIG. 2 is an isometric view of a travel accessory bag attached to a wheeled suitcase, according to an aspect of the invention.
Figure 3:
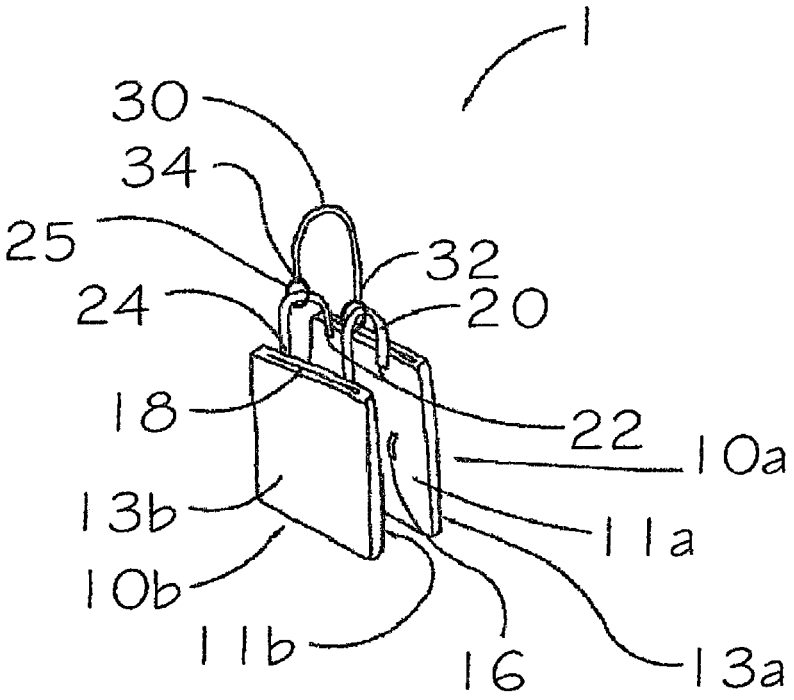
FIG. 3 is an isometric view of a travel accessory bag, according to an aspect of the invention.
Figure 4:
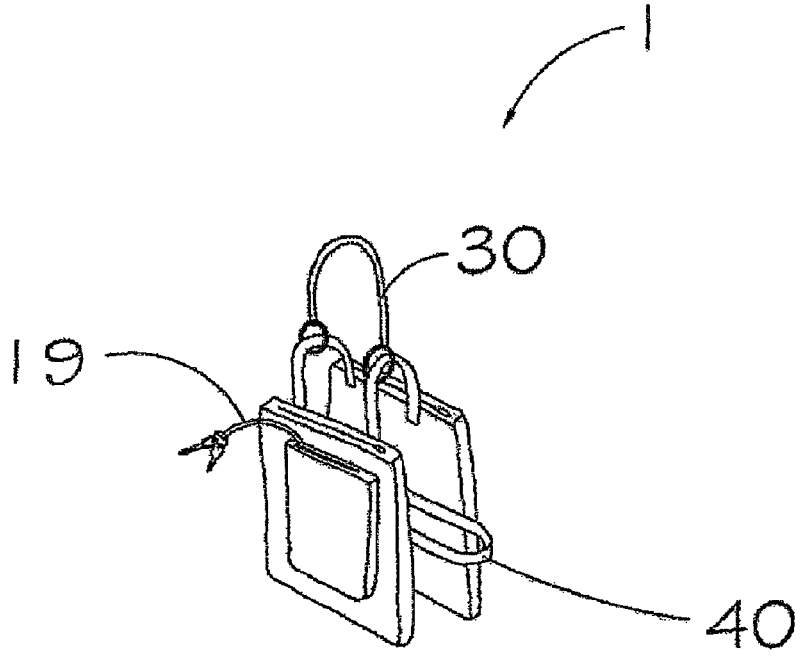
FIG. 4 is an isometric view of a travel accessory bag, according to an aspect of the invention.
Figure 5:
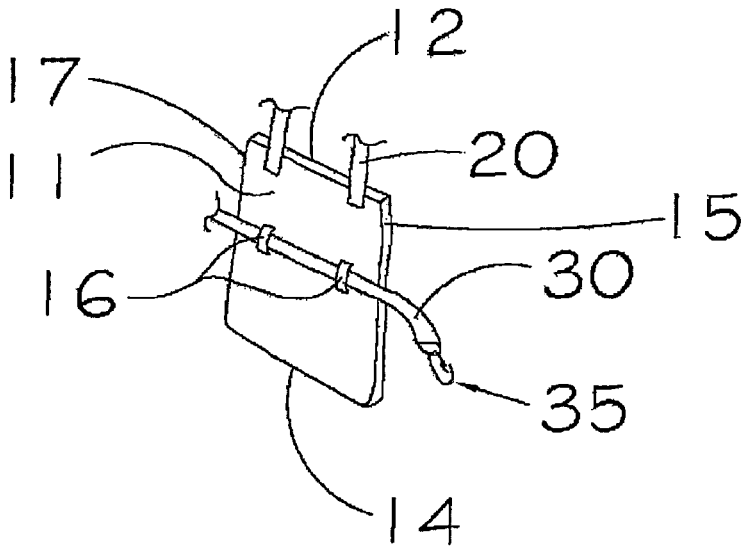
FIG. 5 is a backside view of part of the travel accessory bag, according to an aspect of the invention.
Figure 6:
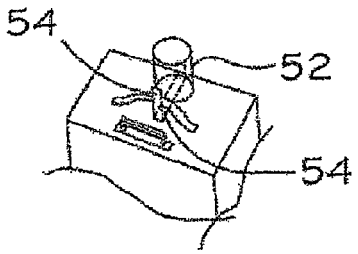
FIG. 6 is an isometric view of a travel accessory cup holder mounted on a wheeled suitcase, according to an aspect of the invention.
Figure 7:
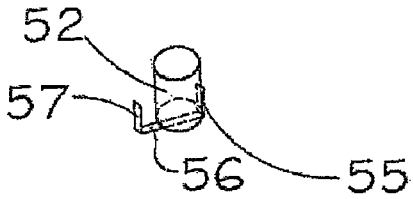
FIG. 7 is an isometric view of a travel accessory cup holder according to an aspect of the invention.
Figure 8:
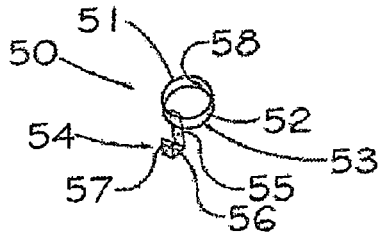
FIG. 8 is an isometric view of a travel accessory cup holder according to an aspect of the invention.
Figure 9:
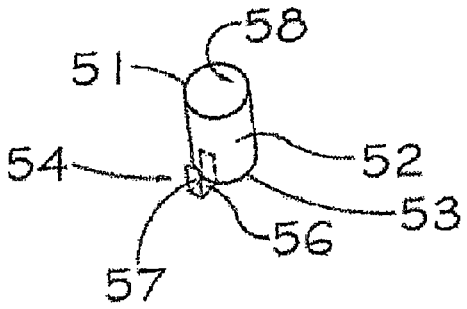
FIG. 9 is an isometric view of a travel accessory cup holder according to an aspect of the invention.

When a suitcase is standing on its wheels, the travel bag 1 is laid over the suitcase, such that one pocket 10 is on either side of the suitcase, and the connecting strips 20 are over the top (see FIG. 1). The connecting strips 20 are sized to reach from one side of the suitcase to the other. When the travel bag 1 is not being secured to a suitcase, it can be carried like a purse by using the shoulder strap 30 (see FIG. 2). According to an aspect of the invention, the shoulder strap 30 may be removably attached to the connecting strips 20, such that when it is not being carried like a purse, the shoulder strap 30 can be removed.

Each fabric pocket 10 has a top edge 12 and an opposing bottom edge 14, and a first side edge 15, and an opposing second side edge 17. According to an aspect of the invention, the fabric pockets 10 have a closing mechanism 18, such as a zipper, or snaps. The fabric pockets 10 may be further designed with multiple openings of different sizes, or additional outer and/or inner pockets sized to hold a variety of items, such as travel documents, phones, computers, or computer tablets. The pockets may further contain attachment loops 19 which can be used for attaching keys, wallets, wristlets, or any other smaller item which can be attached with a loop. This is especially useful for attachment of items the traveler would need quick access to, like keys or a small bag containing travel documents.

The connecting strips 20 each have a first end 22 and a second end 24, and the connecting strip first ends 22 are attached to one of the fabric pocket top edges 12*a* such that one connecting strip first end 22 is attached near the first side edge 15*a*, and one connecting strip first end 22 is attached near the second side edge 17*a*. The connecting strip second ends 24 are attached to the other fabric pocket top edge 12*b*, such that one connecting strip second end 24 is attached near the fabric pocket first side edge, 15*b* and one connecting strip second end 24 is attached near the fabric pocket second side edge 17*b*, and such that the connecting strips 20 are relatively parallel to each other.

The shoulder strap 30 has a first end 32 and an opposing second end 34, and each end is attached to one of the connecting strips 20. According to an aspect of the invention, the shoulder strap 30 is removably attached to the connecting strips 20. The removeable attachment can be accomplished in a number of ways—for example, the shoulder strap ends 32,34 may have snaps, such that the end could be wrapped around the connecting strip, and then attached to itself. According to a further embodiment, the connecting strips each have a strap attachment means 25, such that the shoulder strap ends 32,34 have a complimentary attachment means, and thus each end of the shoulder strap is attached to a strap attachment means 25. One example of this would be metal rings on the connecting strip, and clips 35 on the shoulder strap ends, such that the shoulder strap clips 35 can be attached to the metal rings on the connecting strips.

The fabric pockets 10 (a first fabric pocket 10*a*, and a second fabric pocket 10*b*) further have an inner side 11(*a*,*b*), and an opposing outer side 13(*a*,*b*), wherein the first fabric pocket inner side 11*a* and the second fabric pocket inner side 11*b* face each other when the bag is held by the shoulder strap. These inner sides are the sides that will lay against the suitcase when the travel bag 1 is secured to a suitcase. According to an aspect of the invention, a position securing strap 40 in the form of a fabric belt is attached to both the first fabric pocket inner side 11*a* and the second fabric pocket inner side 11*b*. The size of this fabric belt is of a size to fit around most carry-on luggage, such that when the travel bag 1 is lain over the suitcase, this fabric belt will secure the fabric pockets 10 (*a*,*b*) to the suitcase. In a preferred embodiment, this position securing strap 40 is elastic in nature such that it can stretch over most suitcases, and more securely hold the travel bag 1 in place. In a further embodiment of the invention, the fabric pocket inner sides 11 (*a*,*b*) have a self-attachment means, such as complementary Velcro®, or other attachment means, such that when the travel bag is not on the suitcase, but being worn like a purse, the two fabric pockets can be attached to each other to maintain a low profile.

According to a further aspect of the invention, instead of having the position securing strap 40 attached to the fabric pockets 10 (*a,b*), the fabric pocket inner sides each further comprise a secondary strap attachment means 16 wherein when the bag is lain over a suitcase, the position securing strap 40 is wrapped around the suitcase, and connected to the secondary strap attachment means 16, and secured to itself. In one aspect of the invention, the position securing strap used could be the shoulder strap 30. In this embodiment, the shoulder strap 30 is unattached from the connecting strips 20, looped through the secondary strap attachment means 16, and then the ends of the shoulder strap are attached to each other (see FIG. 1). According to an aspect of the invention, this secondary strap attachment means 16 is an attached fabric strip, like a belt loop, although any available attachment means is considered within the purview of the invention.

According to an aspect of the invention, a cup holder 50 used for travel comprises a semi-rigid to rigid beverage ring 52 and a rigid U-shaped restraint 54. The beverage ring 52 has a top edge 51, and an opposing bottom edge 53, and is sized to fit a standard cup. The U-shaped restraint 54 has a first leg 55, a middle portion 56, and a second leg 57, wherein the first leg 55 is attached to the beverage ring 52. The cup holder beverage ring 52 has an inner circumference 58 and an outer circumference 59, and according to an aspect of the invention, the restraint first leg 55 is attached to the inner circumference 58. In a preferred embodiment, the first leg 55 is attached to the beverage ring 52 such that the beverage ring 52 is between the first leg 55 and the second leg 57. According to a further aspect of the invention, the beverage ring 52 is a foam beverage holder, such as a Koozie®.

I claim:

1. A bag used for travel comprising:

A first fabric pocket and a second fabric pocket, wherein each fabric pocket has a top edge and an opposing bottom edge, and a first side edge, and an opposing second side edge; and, At least 2 connecting strips, each having a first end and a second end, wherein said connecting strip first ends are attached to said first fabric pocket top edge such that one connecting strip first end is attached near said first fabric pocket first side edge, and one connecting strip first end is attached near said first fabric pocket second side edge, and further, wherein said connecting strip second ends are attached to said second fabric pocket top edge, such that one connecting strip second end is attached near said second fabric pocket first side edge, and one connecting strip second end is attached near said second fabric pocket second side edge, and such that the connecting strips are relatively parallel to each other; and, A shoulder strap for carrying the bag, wherein said shoulder strap has a first end and an opposing second end, and wherein each end is attached to one of said connecting strips; and, At least two shoulder strap attachment means, wherein there is a shoulder strap attachment means for each connecting strip, and wherein said shoulder strap attachment means is such that said shoulder strap may be attached to said connecting strips, and unattached from said connecting strips wherein said strap attachment means comprise a metal ring, and a clip, wherein each said connecting strip passes through a metal ring, and wherein each of said shoulder strap ends has one said clip attached, and wherein each clip may be clipped onto each metal ring.

2. A bag used for travel comprising:

A first fabric pocket and a second fabric pocket, wherein each fabric pocket has a top edge and an opposing bottom edge, and a first side edge, and an opposing second side edge; and, At least 2 connecting strips, each having a first end and a second end, wherein said connecting strip first ends are attached to said first fabric pocket top edge such that one connecting strip first end is attached near said first fabric pocket first side edge, and one connecting strip first end is attached near said first fabric pocket second side edge, and further, wherein said connecting strip second ends are attached to said second fabric pocket top edge, such that one connecting strip second end is attached near said second fabric pocket first side edge, and one connecting strip second end is attached near said second fabric pocket second side edge, and such that the connecting strips are relatively parallel to each other; and, A shoulder strap for carrying the bag, wherein said shoulder strap has a first end and an opposing second end, and wherein each end is attached to one of said connecting strips; and, Wherein said fabric pockets further have an inner side, and an opposing outer side, wherein said first fabric pocket inner side and said second fabric pocket inner side face each other when said bag is held by said shoulder strap, and further comprising a position securing strap, wherein said position securing strap is attached to both said first fabric pocket inner side and said second fabric pocket inner side, and wherein said position securing strap is of a size to fit around most carry-on luggage, such that when said travel bag is lain over the luggage, said position securing strap will secure said fabric pockets to the suitcase; and, wherein said first fabric pocket inner side, and said second fabric pocket inner side each further comprise a secondary strap attachment means for attaching said position securing strap, wherein when the bag is lain over a suitcase, said strap is wrapped around the suitcase, and connected to said secondary strap attachment means; and, wherein said shoulder strap is removeable attached to said connecting strips, and wherein said shoulder strap is removed, and is then used as said position securing strap.

* * * * *